US007114348B2

(12) United States Patent
Lifson et al.

(10) Patent No.: US 7,114,348 B2
(45) Date of Patent: Oct. 3, 2006

(54) FLUID DIODE EXPANSION DEVICE FOR HEAT PUMPS

(75) Inventors: Alexander Lifson, Manlius, NY (US); Thomas J. Dobmeier, Phoenix, NY (US); Michael F. Taras, Fayetteville, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 11/252,816

(22) Filed: Oct. 18, 2005

(65) Prior Publication Data

US 2006/0048537 A1 Mar. 9, 2006

(51) Int. Cl.
*F25B 41/06* (2006.01)

(52) U.S. Cl. ..... 62/511

(58) Field of Classification Search ..... 62/324.6, 62/511, 527, 324.1; 236/92 B; 138/40, 138/44; 251/118
See application file for complete search history.

(56) References Cited

U.S. PATENT DOCUMENTS 4,311,020 A * 1/1982 Tobin et al. ..... 62/324.6
4,653,291 A * 3/1987 Moeller et al. ..... 62/511
4,876,859 A 10/1989 Kitamoto
5,004,008 A 4/1991 Drucker
5,029,454 A * 7/1991 Eisberg ..... 62/324.6
5,031,416 A * 7/1991 Drucker et al. ..... 62/324.1
5,038,579 A * 8/1991 Drucker ..... 62/324.6
5,052,192 A * 10/1991 Drucker ..... 62/324.6
5,085,058 A 2/1992 Aaron
5,186,021 A * 2/1993 Keller ..... 62/511
5,341,656 A * 8/1994 Rust et al. ..... 62/324.6
5,345,780 A 9/1994 Aaron et al.
5,715,862 A 2/1998 Palmer
5,813,244 A * 9/1998 Palmer ..... 62/324.6
5,875,637 A 3/1999 Paetow
5,966,960 A * 10/1999 Cummings et al. ..... 62/296
6,006,544 A * 12/1999 Watanabe et al. ..... 62/511
6,047,556 A 4/2000 Lifson
6,199,399 B1 3/2001 Voorhis
6,206,652 B1 3/2001 Caillat

FOREIGN PATENT DOCUMENTS

JP 2-52961 A * 2/1990
JP 8-216666 A * 8/1996

OTHER PUBLICATIONS

Search Report PCT/US05/03731, mailed Jun. 17, 2005.

* cited by examiner

*Primary Examiner*—Mohammad M. Ali
(74) *Attorney, Agent, or Firm*—Carlson, Gaskey & Olds

(57) ABSTRACT

An expansion device for the heat pump applications consists of a flow resistance device that has a different resistance to refrigerant flow depending on the flow direction through this device. The flow resistance device has no moving parts so that it avoids the damage, wear and contamination problems of the moveable piston in the prior art. The flow resistance device is a fixed obstruction about which the fluid must flow when traveling through the expansion device.

9 Claims, 1 Drawing Sheet

FLUID DIODE EXPANSION DEVICE FOR HEAT PUMPS

BACKGROUND OF THE INVENTION

This invention relates to an expansion device for a heat pump.

Heat pumps employ a compressor, an indoor heat exchanger, an outdoor heat exchanger, an expansion device and 4-way reversing valve, to switch operation between cooling and heating modes. Heat pumps utilize an expansion device through which the refrigerant flow expands from high pressure and temperature to low pressure and temperature. Different size restriction of the expansion device is required for proper system operation depending upon whether the heat pump is in a cooling or heating mode of operation. Obviously, when the system is operating in cooling or in heating mode, the direction of the refrigerant flow through the expansion device is reversed.

Prior art heat pump systems with single expansion devices use a moveable piston that moves in a first direction in which its flow resistance is substantially higher than when it is moved in an opposite second direction. The first direction corresponds to the heating mode and second direction corresponds the cooling mode. The piston is prone to wear, which adversely effects the operation and reliability of the system due to undesirably large tolerances and contamination. Furthermore, modern heat pump systems are incorporating alternate refrigerants, such as R410A, and POE oils. The system utilizing R410A refrigerant operate at much higher pressure differentials than more common R22 and R134A refrigerants employed in the past within the system. This adversely impacts the expansion device wear, lubrication and results in higher loads during transient conditions of operation.

Therefore, there is a need for a single reliable, inexpensive expansion device for the heat pump systems that is not as prone to wear and reliability problems.

SUMMARY OF THE INVENTION

The inventive heat pump expansion device consists of a flow resistance device that has a different resistance to flow depending on the flow direction through this device. The flow resistance device is fixed or rigidly mounted relative to first and second fluid passages so that it avoids the wear problems of the moveable piston in the prior art. The fluid flow resistance device in several examples of the invention is a fixed obstruction about which the refrigerant must flow when traveling through the expansion device. The flow resistance device has features on one side that create a low drag coefficient when the refrigerant flows in one direction but a high drag coefficient when the refrigerant flows in the opposing direction.

Accordingly, the present invention provides a reliable, inexpensive expansion device that is not as prone to wear and reduces reliability problems.

These and other features of the present invention can be best understood from the following specification and drawings, the following of which is a brief description.

DETAILED DESCRIPTION OF THE PREFERRED EMBODIMENT

Figure 1:
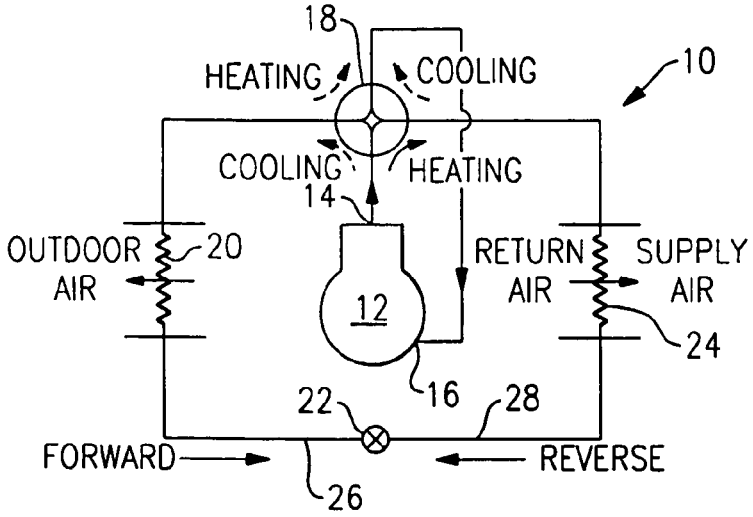
FIG. 1 is a schematic view of a heat pump having the inventive expansion device.

A heat pump 10 utilizing the present invention and capable of operating in both cooling and heating modes is shown schematically in FIG. 1. The heat pump 10 includes a compressor 12. The compressor 12 delivers refrigerant through a discharge port 14 that is returned back to the compressor through a suction port 16.

Refrigerant moves through a four-way valve 18 that can be switched between heating and cooling positions to direct the refrigerant flow in a desired manner (indicated by the arrows associated with valve 18 in FIG. 1) depending upon the requested mode of operation, as is well known in the art. When the valve 18 is positioned in the cooling position, refrigerant flows from the discharge port 14 through the valve 18 to an outdoor heat exchanger 20 where heat from the compressed refrigerant is rejected to a secondary fluid, such as air. The refrigerant flows from the outdoor heat exchanger 20 through a first fluid passage 26 of the inventive expansion device 22. The refrigerant when flowing in this forward direction expands as it moves from the first fluid passage to a second fluid passage 28 thereby reducing its pressure and temperature. The expanded refrigerant flows through an indoor heat exchanger 24 to accept heat from another secondary fluid and supply cold air indoors. The refrigerant returns from the indoor exchanger 24 to the suction port 16 through the valve 18.

When the valve 18 is in the heating position, refrigerant flows from the discharge port 14 through the valve 18 to the indoor heat exchanger 24 where heat is rejected to the indoors. The refrigerant flows from the indoor heat exchanger 24 through second fluid passage 28 to the expansion device 22. As the refrigerant flows in this reverse direction from the second fluid passage 28 through the expansion device 22 to the first fluid passage 26, the refrigerant flow is more restricted in this direction as compared to the forward direction. The refrigerant flows from the first fluid passage 26 through the outdoor heat exchanger 20, four-way valve 18 and back to the suction port 16 through the valve 18.

Several examples of the inventive expansion device are shown in FIGS. 2–6. The inventive expansion device 22 includes a flow resistance device 30 that is arranged between the first 26 and second 28 fluid passages. Unlike the prior art moveable piston, the flow resistance device 30 is fixed relative to the fluid passages 26 and 28 so that it does not have any features that are subject to damage, wear or contamination. The flow resistance device 30 is shown schematically supported by a pin. The flow resistance device 30 has lower fluid resistance when the refrigerant is flowing in the forward or cooling direction than when refrigerant is flowing in the reverse or heating direction, acting as a fluid diode. This variable fluid resistance is achieved by providing different features on either side of the flow resistance device 30 that increases the fluid resistance in one direction and provides lower fluid resistance in the other direction.

Figure 2:
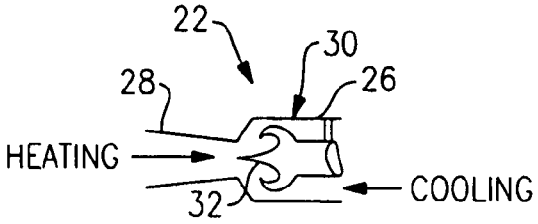
FIG. 2 to a cross-sectional view of a first example of the inventive expansion device.

Referring to FIG. 2, the flow resistance device 30 includes a barbed end 32 facing the second fluid passage 28. When the refrigerant is flowing in the forward or cooling direction, the refrigerant flows about smooth surfaces of the flow resistance device 30 so that the arrangement of the flow resistance device 30 between the passages 26 and 28 creates relatively little resistance. However, when the refrigerant flows in the reverse order or heating direction, the refrigerant flows into the barbed end 32 creating a very high drag or resistance to the fluid flow.

Figure 3:
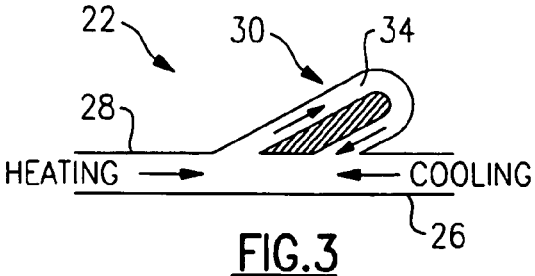
FIG. 3 is a cross-sectional view of second example of the inventive expansion device.

Another example of the invention is shown in FIG. 3, which utilizes an angled fluid passage 34 as the flow resistance device 30. The angled fluid passage 34 is arranged such that refrigerant flowing in the cooling direction generally bypasses the angled fluid passage 34 flowing more directly through to the second fluid passage 28. However, when the refrigerant flows in the heating direction the refrigerant more easily flows into the angled fluid passage 34 due to its orientation relative to the second fluid passage 28. Fluid flow from the second fluid passage 28 into the entry of the angled fluid passage 34 is better maintained due to the shallow angle of the wall between the second fluid passage 28 and the wall at the opening of the angled fluid passage 34. The refrigerant exits the angled fluid passage 34 in such a manner that it is directed back into the flow of refrigerant flowing from the second fluid passage 28 to the first fluid passage 26 creating turbulence and generating an increased flow resistance as compared to refrigerant flowing in the cooling direction.

Figure 4:
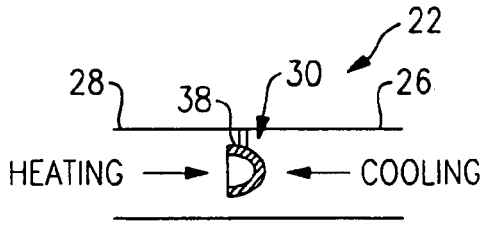
FIG. 4 is a cross-sectional view of a third example of the inventive expansion device.
Figure 5:
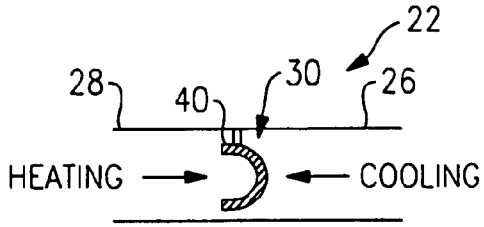
FIG. 5 is a cross-sectional view of a fourth exampled of the inventive expansion device.

Referring to FIGS. 4 and 5, the flow resistance device 30 is arranged between the fluid passages 26 and 28 in a similar manner to that shown in FIG. 2. As shown in FIG. 4, the flow resistance device 30 is an open faced hemisphere 38, and the flow resistance device 30 shown in FIG. 5 is a C-shaped channel 40 arranged between the fluid passages 26 and 28. As the refrigerant flows in the cooling direction, the smooth rounded surface of the flow resistance devices 30 have a relatively low drag coefficient. However, when the refrigerant flows in the heating direction into the cupped area of the flow resistance devices 30, a relatively high drag coefficient is experienced increasing the flow resistance in the heating direction.

It should be appreciated that the flow resistances can be expressed using various terminology. For example, the flow resistances can be expressed as drag coefficients. The flow resistances can also be expressed as relative degrees of turbulent or laminar flows. In any event, the change in flow resistance based upon the direction of refrigerant flow is achieved by utilizing a fixed flow resistance device.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant system operating as a heat pump comprising:

a flowing fluid and a compressor communicating with first and second heat exchangers;

and an expansion device communicating via first fluid passages with said first heat exchanger and communicating via second fluid passage with said second heat exchangers said expansion device including a flow resistance device arranged between first and second fluid passages and in fixed relationship thereto, said flow resistance device providing a first fluid resistance for said flowing fluid in a first direction and a second fluid resistance greater than said first resistance for said flowing fluid in a second opposite direction, said flow resistance device defining a non-circular cross-sectional flow area, and said flow area being defined between an inner fixed portion and an outer fixed portion.

2. The heat pump according to claim 1, comprising a four way reversing valve movable between heating and cooling positions respectively providing fluid flow in said first and second directions.

3. The heat pump according to claim 1, wherein said flow resistance device includes a body having an entrance and exit side of different geometry.

4. The heat pump according to claim 3, wherein said second side included a barbed-like face.

5. The heat pump according to claim 3, wherein said second side is a an open face hemisphere.

6. The heat pump according to claim 3, wherein said flow resistance device is a C-shaped channel with said second side provided by an open face.

7. The heat pump according to claim 1, wherein said flow resistance device is a bypass angled fluid passage.

8. A refrigerant system operating as a heat pump comprising:

a flowing fluid and a compressor communicating with first and second heat exchangers; and an expansion device communicating via first fluid passages with said first heat exchanger and communicating via second fluid passage with said second heat exchangers said expansion device including a flow resistance device anranged between first and second fluid passages and in fixed relationship thereto, said flow resistance device providing a first fluid resistance for said flowing fluid in a first direction when the heat pump is in a cooling mode, and a second fluid resistance greater than said first resistance for said flowing fluid in a second opposite direction when the heat pump is in a heating mode, said flow resistance device having an outwardly curved surface facing a flow of refrigerant when the heat pump is in the cooling mode, and a curved hollow surface facing a flow of refrigerant when the heat pump is in the heating mode.

9. The refrigerant system as set forth in claim 8, wherein said flow resistance device has a C-shaped channel, with said outwardly curved surface being formed by an outer surface of said C-shaped channel, and said curved hollow surface provided by the inner side of the C-shaped channel.

* * * * *

UNITED STATES PATENT AND TRADEMARK OFFICE

CERTIFICATE OF CORRECTION

PATENT NO. : 7,114,348 B2
APPLICATION NO. : 11/252816
DATED : October 3, 2006
INVENTOR(S) : Lifson et al.

It is certified that error appears in the above-identified patent and that said Letters Patent is hereby corrected as shown below:

On the Title Page:
Please insert the following:

Related U.S. Application Data
item (63) Divisional of application No. 10/784,409, filed on February 23, 2004, now U.S. Patent No. 7,043,937.

In the claims:
Column 4, line 39: “anranged” should be --arranged--
Column 4, line 55: Please insert --being-- after “surface”

Signed and Sealed this

Nineteenth Day of December, 2006

JON W. DUDAS
*Director of the United States Patent and Trademark Office*